US008014715B2

(12) United States Patent
Nakamura et al.

(10) Patent No.: US 8,014,715 B2
(45) Date of Patent: Sep. 6, 2011

(54) FIXING APPARATUS USING FIXING SOLUTION AND IMAGE FORMING APPARATUS INCLUDING THE FIXING APPARATUS

(75) Inventors: Takuma Nakamura, Kanagawa (JP); Takeshi Saitoh, Tokyo (JP); Yuko Arizumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 332 days.

(21) Appl. No.: 12/432,197

(22) Filed: Apr. 29, 2009

(65) Prior Publication Data

US 2009/0324309 A1 Dec. 31, 2009

(30) Foreign Application Priority Data

Jun. 30, 2008 (JP) ..... 2008-171497

(51) Int. Cl.
*G03G 15/20* (2006.01)
*G03G 15/16* (2006.01)

(52) U.S. Cl. ..... 399/340; 399/122; 399/320

(58) Field of Classification Search ..... 399/122, 399/320, 324, 325, 340, 67
See application file for complete search history.

(56) References Cited

U.S. PATENT DOCUMENTS

| | | | | |
|---|---|---|---|---|
| 3,158,509 | A | 11/1964 | Hudson | |
| 2006/0133866 | A1 * | 6/2006 | Asakura et al. | 399/320 |
| 2007/0231027 | A1 * | 10/2007 | Kamei et al. | 399/329 |
| 2008/0069612 | A1 * | 3/2008 | Nakamura et al. | 399/340 |
| 2009/0129829 | A1 * | 5/2009 | Saito | 399/308 |

FOREIGN PATENT DOCUMENTS

| | | |
|---|---|---|
| JP | 40-10867 | 6/1965 |
| JP | 3290513 | 3/2002 |
| JP | 2004-109747 | 4/2004 |
| JP | 2006-163083 | 6/2006 |
| JP | 2007-121448 | 5/2007 |

* cited by examiner

*Primary Examiner* — David Porta
*Assistant Examiner* — Jessica L Eley
(74) *Attorney, Agent, or Firm* — Oblon, Spivak, McClelland, Maier & Neustadt, L.L.P.

(57) ABSTRACT

A fixing apparatus to fix unfixed toner carried on a surface of a recording medium by attaching a fixing solution capable of softening toner onto the unfixed toner is provided. The fixing apparatus includes a sprayer to spray the fixing solution; a fixing solution charging part to charge the fixing solution; a first electrode to rotate and provided on a same side of the recording medium as the surface carrying the unfixed toner; a second electrode provided on an opposite side of the recording medium to the surface carrying the unfixed toner; and a voltage applying part to generate an electric field between the first electrode and the second electrode so that the fixing solution sprayed by the sprayer and charged by the fixing solution charging part moves toward the second electrode.

14 Claims, 9 Drawing Sheets

FIXING APPARATUS USING FIXING SOLUTION AND IMAGE FORMING APPARATUS INCLUDING THE FIXING APPARATUS

BACKGROUND OF THE INVENTION

1. Field of the Invention

The present invention generally relates to a fixing apparatus to fix a toner image on a recording medium by using a fixing solution and an image forming apparatus such as a copier, a multifunction peripheral, a printer, and a facsimile machine, which includes the fixing apparatus, and more specifically, to a configuration to efficiently attach a fixing solution to unfixed toner carried on the recording medium.

2. Description of the Related Art

In recent years, there have been various apparatuses to form images on recording paper, such as a copier, a printer, and a facsimile machine. Among these apparatuses, an electrophotographic type image forming apparatus that uses toner has been predominantly used in offices and the like since images can be formed on normal paper at high speed with high density, and recently, even color images can be easily formed on recording paper. Most of the electrophotographic type image forming apparatuses employ heat to fix images. By this method, a roller, a film, and the like heated by a heating element such as a halogen heater and a ceramic heater sandwich recording paper having unfixed toner on the surface, to heat and pressurize the recording paper. As a result, the unfixed toner is fused and deformed, and fused (anchored) into fibers of the recording paper to be fixed therein.

This method is widely used because of advantages in that images are formed with high uniformity and the image forming apparatus is stably operated, however, there is a disadvantage of consuming too much power. To solve this problem, a heating method and a vapor fixing method have been employed as a method for fixing toner (for example, see Patent Document 1).

By the vapor fixing method, recording paper having unfixed toner on the surface is exposed to solvent vapor that melts toner, thereby the unfixed toner is swollen or dissolved so as to be fixed on the recording paper. This method requires less power consumption than the heating method; however, a liquid used as the solvent to dissolve the toner is odiferous or may have an adverse effect on a human body. Therefore, this method has failed to be a predominant method.

In recent years, with a development of a non-odiferous solution that has no adverse effect on a human body, and can swell or dissolve toner to be fixed, a fixing method by using a solution has started to be used again. There have been disclosed many ways to supply a solution, which is non-odiferous and has no adverse effect on a human body, and swells or dissolves toner, on a recording medium carrying unfixed toner.

For example, a wet fixing method to fix toner has been disclosed (for example, see Patent Document 2). In the wet fixing method, an oil-in-water type (O/W type) fixing solvent which can dissolve or swell toner is used. The oil-in-water type fixing solvent is formed by dispersively mixing an organic compound, which cannot be dissolved or hardly dissolved in water, with water. The wet fixing method is performed such that the oil-in-water type fixing solvent is sprayed or deposited in drops onto a surface of an object having unfixed toner at a predetermined position so that the unfixed toner is dissolved or swollen, and then the object is dried.

By performing the wet fixing method, however, toner that is only electrostatically attached to the recording paper may be moved depending on a diameter of the droplets of the sprayed or deposited fixing solvent and a speed at which the droplets of the fixing solvent and toner are collided with each other (kinetic energy). Therefore, an image may be formed with a defect.

In view of the above problems, a fixing apparatus using an electrostatic force has been disclosed (for example, see Patent Documents 3 and 4). In the fixing apparatus, a fixing solution is charged with an opposite polarity to that of the toner so that the fixing solution is attached to the toner by a coulomb force generated with the toner. Therefore, a speed at which the toner image and the fixing solution are collided with each other can be moderated comparing to the above-described fixing method. As a result, since the kinetic energy can be decreased, probability that an image is formed with a defect due to a moved toner image is reduced.

[Patent Document 1] Japanese Published Examined Patent Application No. S40-10867

[Patent Document 2] Japanese Patent No. 3290513

[Patent Document 3] Japanese Patent Application Publication No. 2006-163083

[Patent Document 4] Japanese Patent Application Publication No. 2007-121448

According to the configurations disclosed in Patent Documents 3 and 4, however, droplets of a fixing solution are carried to an opening by using a fan, and attached onto toner through the opening. Therefore, droplets of the fixing solution which are apart from the surface having the toner image are more likely to be influenced by an air flow of the fan, than the coulomb force, while droplets which are close to the surface having the toner image are influenced by the coulomb force. Thus, the droplets of the fixing solution cannot be efficiently attached to the toner image.

The present invention is made in view of the abode-described problems, and it is an object of at least one embodiment of the present invention to improve attachment efficiency between a fixing solution that softens or melts toner and unfixed toner carried on a recording medium, and to prevent an image from being formed with a defect.

SUMMARY OF THE INVENTION

According to one aspect of the present invention, a fixing apparatus to fix unfixed toner carried on a surface of a recording medium by attaching a fixing solution capable of softening toner onto the unfixed toner is provided. The fixing apparatus includes a sprayer to spray the fixing solution; a fixing solution charging part to charge the fixing solution; a first electrode to rotate and provided on a same side of the recording medium as the surface carrying the unfixed toner; a second electrode provided on an opposite side of the recording medium to the surface carrying the unfixed toner; and a voltage applying part to generate an electric field between the first electrode and the second electrode so that the fixing solution sprayed by the sprayer and charged by the fixing solution charging part moves toward the second electrode.

DETAILED DESCRIPTION OF THE PREFERRED EMBODIMENTS

Embodiments of the present invention are described below, in which the present invention is applied to a copier serving as an image forming apparatus.

Embodiment 1

Figure 1:
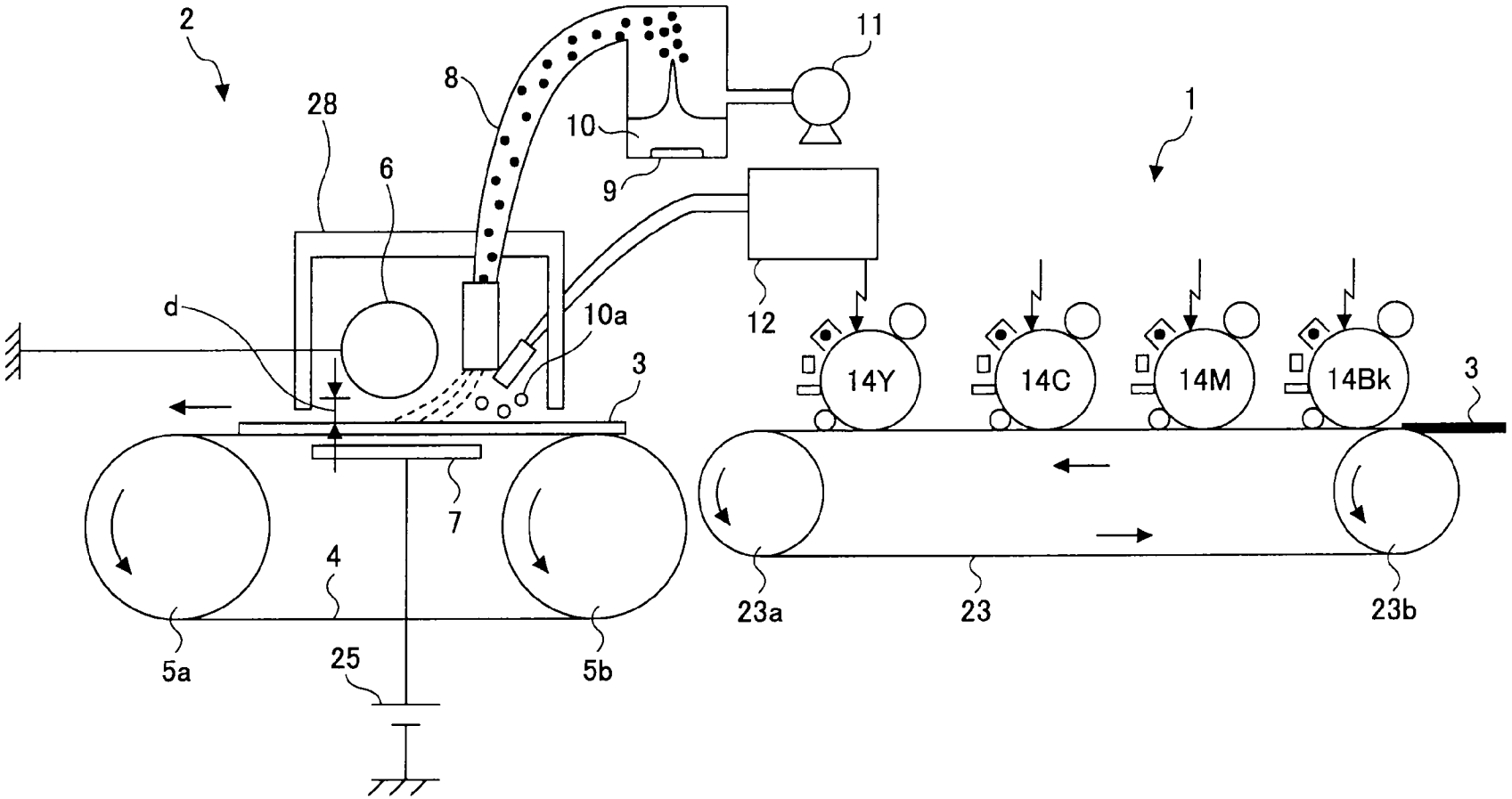
FIG. 1 is an overall configuration of an image forming apparatus to which a fixing apparatus of the present invention is applied.

FIG. 1 is a diagram showing an image forming part 1 and a fixing part 2 of an image forming apparatus as one embodiment of the present invention.

Figure 2:
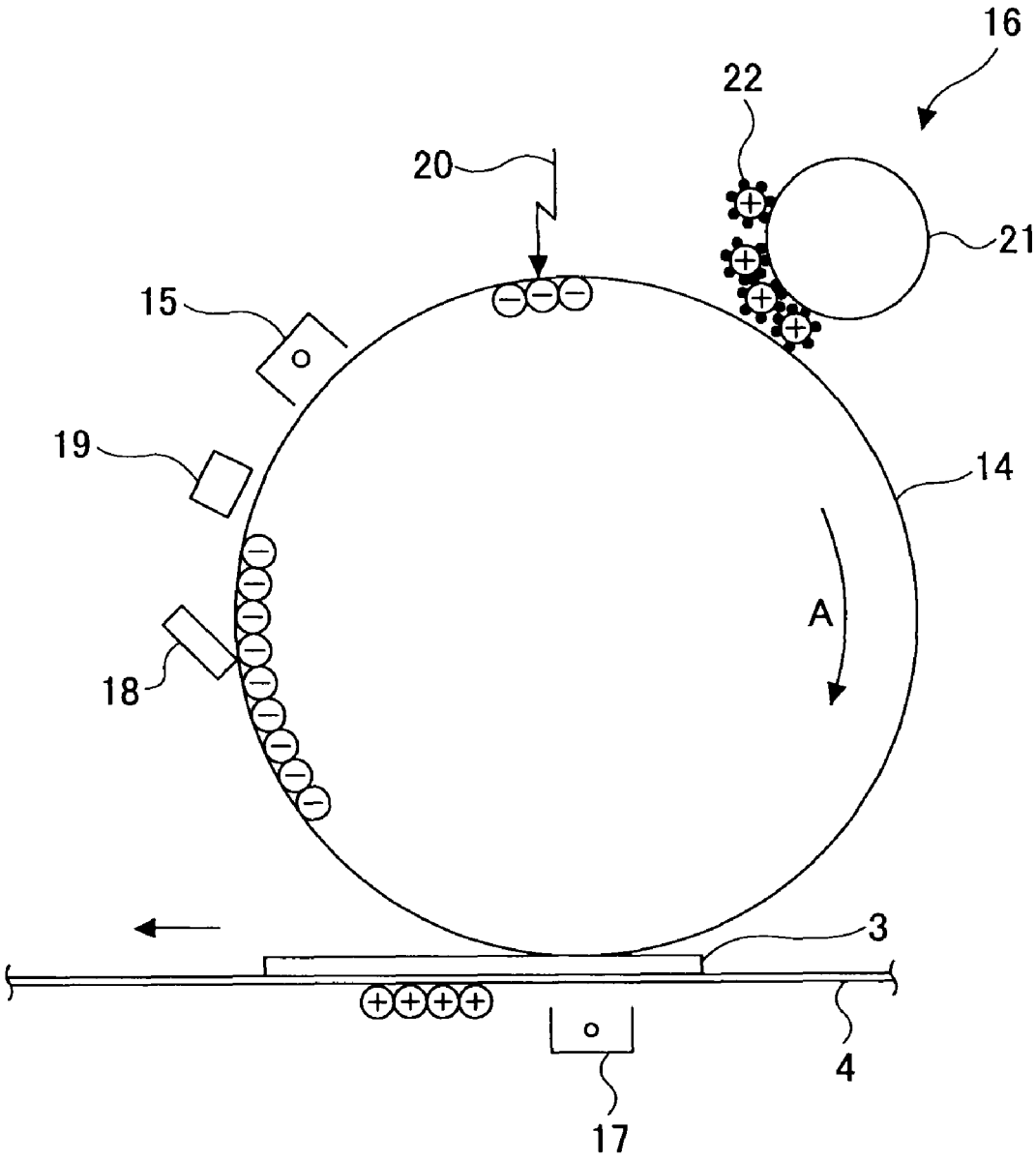
FIG. 2 is a detailed drawing of an image forming part shown in FIG. 1.

First, the image forming part 1 is described. FIG. 2 is a diagram showing a specific configuration around a photosensitive body 14, which corresponds to one of photosensitive bodies 14Y, 14C, 14M, and 14Bk in FIG. 1 each serving as a latent image carrier. A charger 15, a developing apparatus 16, a transfer apparatus 17, a cleaner 18, and an antistatic lamp 19 are provided around the photosensitive body 14 serving as the latent image carrier. In a copying operation, the photosensitive body 14 is driven by a driving unit such as a driving motor which is not shown, to be rotated in a direction of arrow A at a constant speed. After the photosensitive body 14 is negatively charged uniformly by the charger 15, a document optical image is formed on the photosensitive body 14 by a not-shown exposure apparatus 20 via lighting and an imaging optics, so that the electrostatic latent image is carried on a peripheral surface of the photosensitive body 14. Then, the electrostatic latent image carried on the photosensitive body 14 is rotated by the photosensitive body 14 and reaches a position to face the developing apparatus 16. The developing apparatus 16 has a developing sleeve 21 on which carriers 22 are positively charged. Negatively charged toner that is attached to the positively charged carriers 22 is developed onto the photosensitive body 14. A toner image developed on the electrostatic latent image is then carried to the transfer apparatus 17. The toner image carried on the peripheral surface of the photosensitive body 14 is transferred onto a recording medium 3 which has been carried by a carrier belt 4. The recording medium 3 carrying the transferred toner image which has not been fixed yet is carried to a fixing apparatus 2. After the photosensitive body 14 passes by the transfer apparatus 17, residual toner on the peripheral surface of the photosensitive body 14 is removed by the cleaner 18, and a charge on the photosensitive body 14 is completely removed by the antistatic lamp 19. By repeating these operations, images are formed on the recording medium.

Here, FIG. 1 shows a tandem type copier provided with the photosensitive bodies 14Bk, 14C, 14M, and 14Y respectively for toner colors Bk, C, M and Y. However, the present invention is not limited to this type of copier and can be applied to a one-drum type image forming apparatus as well. Further, the image is directly transferred from the photosensitive body onto the recording medium in FIG. 1; however, the present invention is not limited to this system and may employ a configuration including an intermediate transfer body.

Figure 3:
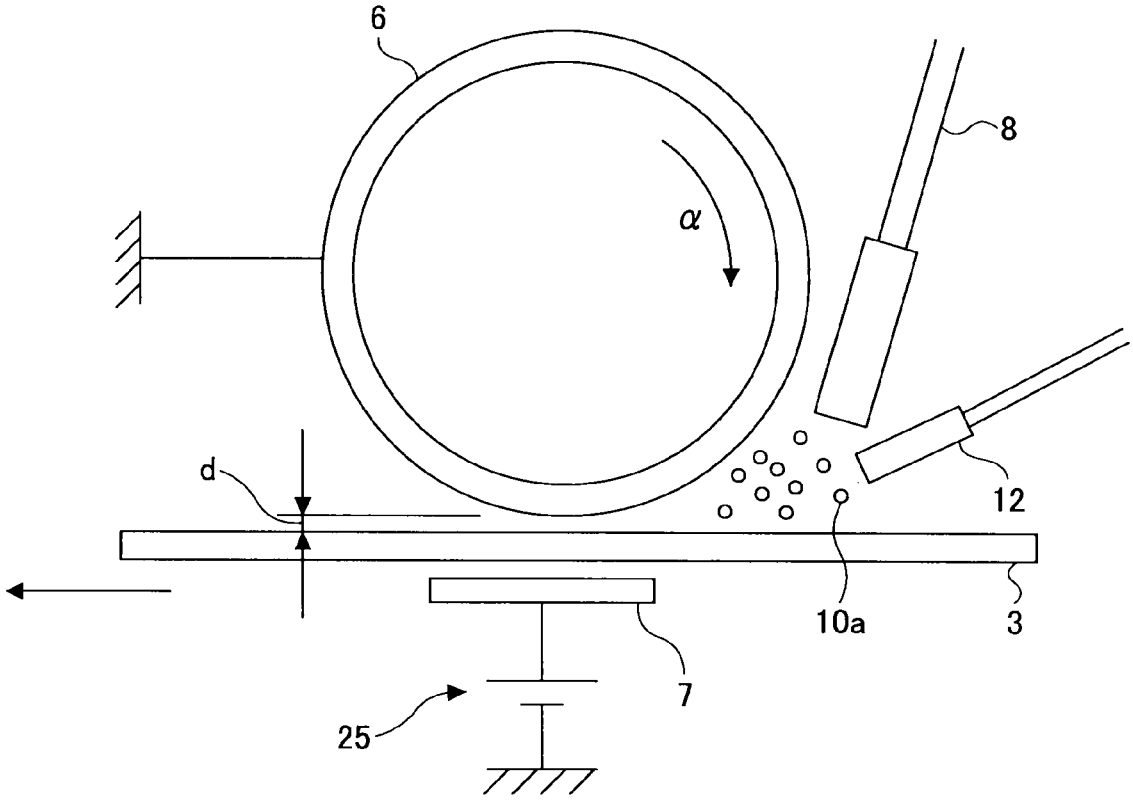
FIG. 3 is a detailed drawing of a fixing apparatus shown in FIG. 1, according to embodiment 1.

Next, the fixing apparatus 2 is described in detail with reference to FIGS. 1 and 3. The fixing apparatus 2 includes a guiding roller 6, an electrode 7, a sprayer 8 for spraying droplets of a fixing solution 10 in a spray box 28, and an ionizer 12 for charging the sprayed droplets.

The spray box 28 prevents the fixing solution 10 from being discharged outside the fixing apparatus 2. Therefore, the shape of the spray box 28 is not limited to a box shape as shown in FIG. 1, and may be appropriately determined by a configuration of the employed fixing apparatus, as long as it can contain a sprayed fixing solution and prevent the fixing solution from floating outside the fixing apparatus in the image forming apparatus. Further, the spray box 28 may be formed of a material appropriately selected depending on the characteristics of a fixing solution to be used, as long as the material is not chemically reactive with the fixing solution.

The sprayer 8 is formed of an oscillator 9, the fixing solution 10, and a pump 11 for generating an air flow. The oscillator 9 is provided in the fixing solution 10 held in the sprayer 8. When an alternating current with a specific high frequency is applied to the oscillator 9, the oscillator 9 resonates with the fixing solution 10. As a result, micro droplets 10*a* are generated on a surface of the fixing solution 10. Next, the pump 11 generates an air flow to carry the micro droplets 10*a*, which are generated by the action of the oscillator 9 and stagnant on the surface of the fixing solution 10, into the spray box 28. In this embodiment, an alternating current with a high frequency of 130 kHz or higher is applied to the oscillator 9 so that the droplets have a diameter of 16 μm (micrometer) or less. When the micro droplets 10*a* of the fixing solution (hereinafter simply referred to as "droplets 10*a* of fixing solution") have a diameter of 16 μm or less, an amount of the fixing solution 10 required to fix unfixed toner on the recording medium 3 can be reduced. Note that a relationship between the frequency of the alternating current applied to the oscillator 9 and the diameter of the generated droplets 10*a* of the fixing solution is derived from a formula 1 below, based on a liquid density of the fixing solution 10 and a surface tension of the fixing solution 10.

$$d=0.34(8\pi T/\rho f^2)^{1/3} \quad \text{(Formula 1)}$$

d; diameter of droplet $d \propto T$ (T; surface tension of liquid)

$d \propto 1/\rho$ (ρ; density of liquid)

$d \propto 1/f$ (f; frequency)

The ionizer 12 generates negative air ions to charge the fixing solution. The droplets 10*a* of the fixing solution 10 sprayed from the sprayer 8 into the spray box 28 are mixed with the negative air ions generated by the ionizer 12 and negatively charged. Accordingly, the droplets 10*a* of the fixing solution 10, which are negatively charged, float in the spray box 28.

The guiding roller 6 serves as an electrode positioned on a side of a surface carrying unfixed toner of the recording medium 3. When the guiding roller 6 is rotated, an air flow is generated on a surface layer of the guiding roller 6. Moreover, the guiding roller 6 used as the electrode is grounded or applied with a voltage to generate an electric field which causes the droplets 10*a* of the fixing solution floating between the electrode 7 and the guiding roller 6 to move to the electrode 7 side. In this embodiment, the guiding roller 6 is grounded. Therefore, the material of the guiding roller 6 may be appropriately selected depending on the kind of fixing solution to be used, as long as the material is a conductor such as a metal, which is not chemically reactive with the fixing solution 10. The guiding roller 6 is used as the electrode positioned on a side of the surface carrying the unfixed toner of the recording medium 3 in this embodiment, however, the electrode is not limited to the guiding roller 6. An endless belt wrapped around tension rollers to be rotated, or a plate-shaped rotation body may be used as the electrode. To achieve a constant effect as the electrode, however, it is preferable to use a roller, a belt, and the like as described in this embodiment, which does not change an electric field generated with the electrode 7 even when the electrode is rotated. If the strength of the electric field with the electrode 7 is changed by the rotation of the electrode, the droplets 10*a* of the fixing solution do not attach to the unfixed toner carried on the recording medium 3 at a constant amount, which may cause variation in fixation. When a roller is used as the electrode as described in this embodiment, a solid electrode having a hollow structure as shown in FIG. 3 can be used as well.

The electrode 7 is a plate-shaped electrode positioned on a side of the opposite surface of the recording medium 3 to the surface carrying the unfixed toner. Like the guiding roller 6, the electrode 7 is grounded or applied with a voltage to generate an electric field which causes the droplets 10*a* of the fixing solution floating between the electrode 7 and the guiding roller 6 to move to the electrode 7 side. In this embodiment, a positive voltage is applied to the electrode 7 from, for example, a DC power source 25 serving as a voltage applying unit. Further, like the guiding roller 6, the electrode 7 may be formed of a conductor such as a metal. In specific, iron, copper, and the like can be used as a material of the electrode 7. The plate-shaped electrode is used in this embodiment; however, the electrode 7 is not limited to have the plate shape. The shape of the electrode 7, which is provided on the opposite surface side of the recording medium 3 to the surface carrying the unfixed toner, can be selected from various shapes. For example, a rotation body such as a roller can be employed as the electrode 7, in a similar manner to the guiding roller 6. When the electrode 7 is a roller-shaped electrode, the electrode 7 can also function as a carrier roller. In this case, the carrier belt 4 is no longer required; therefore, the fixing apparatus 2 can have a simpler structure.

The DC power source 25 is used as the voltage applying unit to generate an electric field between the guiding roller 6 and the electrode 7 so that the droplets 10*a* of the fixing solution move to the electrode 7 side. In this embodiment, a positive voltage is applied only to the electrode 7 while the guiding roller 6 is grounded. Thus, there is a potential difference between the guiding roller 6 and the electrode 7, whereby an electric field directed from the electrode 7 to the guiding roller 6 is generated. Therefore, when the negatively charged droplets 10*a* of the fixing solution float between the guiding roller 6 and the electrode 7, the droplets 10*a* are moved to the electrode 7 side by being subjected to the force of the generated electric field. The electrode to which the voltage applying unit applies the voltage is not limited in this embodiment as long as an electric field is generated between the guiding roller 6 and the electrode 7, which causes the droplets 10*a* of the fixing solution to move to the electrode 7 side. That is, the voltage applying unit may apply a voltage to only the guiding roller 6 or both the guiding roller 6 and the electrode 7, depending on the charge polarity and the like of the droplets 10*a* of the fixing solution. Further, the voltage applying unit is not limited to the DC power source, and may be an electric storage device such as an electric double layer capacitor and a secondary battery.

Next, a fixing operation of the fixing apparatus 2 is described. FIG. 3 is a diagram showing details of the fixing apparatus 2. The recording medium 3 on which a toner image is transferred by the transfer apparatus 17 is carried by the carrier belt into the spray box 28 of the fixing apparatus 2. The droplets 10*a* of the fixing solution which are sprayed by the sprayer 8 and negatively charged by the ionizer 12 float in the spray box 28. The droplets 10*a* of the fixing solution which are present in the vicinity of the surface of the guiding roller 6 are guided between the guiding roller 6 and the electrode 7 by the force of the air flow generated over the surface layer of the guiding roller 6 by the rotation of the guiding roller 6. Since there is an electric field generated between the electrode 7 and the guiding roller 6, the guided droplets 10*a* of the fixing solution which are negatively charged are moved to the electrode 7 side by being subjected to the force of the electric field. As a result, the droplets 10*a* are tightly attached to the unfixed toner carried on the recording medium 3 which passes between the electrodes 6 and 7. The droplets swell or dissolve the unfixed toner so that the unfixed toner is fixed on the recording medium 3.

Here, description is made of a relationship among the polarities of the electrode 7, the guiding roller 6, and the droplets 10*a* of the fixing solution, whereby the droplets 10*a* are charged by being mixed with the air ions generated by the ionizer 12 serving as a fixing solution charging unit.

In this embodiment, the guiding roller 6 is grounded while a positive voltage is applied to the electrode 7. Therefore, an electric field directed from the electrode 7 to the guiding roller 6 is generated between the guiding roller 6 and the electrode 7. Since the droplets 10*a* of the fixing solution which are negatively charged are subjected to a force toward the electrode 7 in the electric field, the droplets 10*a* are efficiently attached to the unfixed toner carried on the recording medium 3 which passes between the guiding roller 6 and the electrode 7.

That is, the polarities of the electrode 7, the guiding roller 6, and the droplets 10*a* of the fixing solution (polarity of the air ions generated by the ionizer 12) are not limited to those described in this embodiment. These polarities may be appropriately set as long as the droplets 10*a* of the fixing solution move to the electrode 7 side, which is provided on the opposite side of the recording medium 3 to the surface carrying the unfixed toner, by being subjected to the force of the electric field generated between the guiding roller 6 and the electrode 7 and attach to the unfixed toner carried on the recording medium 3 which passes between the electrode 7 and the guiding roller 6. On the contrary, a relationship of the polarities which causes the droplets 10*a* to move to the guiding roller 6 instead of the electrode 7 cannot be employed since the effect of the present invention cannot be obtained. When the fixing solution is not charged, the droplets 10*a* of the fixing solution are not subjected to any force by the electric field when floating in the electric field. Therefore, the droplets 10*a* of the fixing solution are required to have one of the positive and negative polarities.

First, a relationship of the polarities between the electrode 7 and the droplets 10*a* of the fixing solution is described. In this embodiment, a positive voltage is applied to the electrode 7 while the droplets 10*a* of the fixing solution are negatively charged. However, the polarities of the electrode 7 and the droplets 10*a* of the fixing solution are not necessarily opposite to each other as long as the droplets 10*a* move to the electrode 7 side by being subjected to a force of the electric field generated between the electrode 7 and the guiding roller 6. That is, even when the electrode 7 and the droplets 10*a* have the same polarity or the electrode 7 is grounded, the droplets 10*a* of the fixing solution can be moved to the electrode 7 side by being subjected to a force of the electric field generated between the electrode 7 and the guiding roller 6. However, when the electrode 7 and the droplets 10*a* of the fixing solution have opposite polarities to each other, even the droplets 10*a* which were not guided to the space between the guiding roller 6 and the electrode 7 can be moved to the electrode 7 side since an attracting coulomb force is generated between the electrode 7 and the droplets 10*a* of the fixing solution which float in the vicinity of the electrode 7. As a result, compared to the case where the electrode 7 and the droplets 10*a* of the fixing solution are not set to have the opposite polarities to each other, the attachment efficiency between the droplets 10*a* and the unfixed toner carried on the recording medium 3 can be improved. Thus, it is preferable that the electrode 7 and the droplets 10*a* of the fixing solution have the opposite polarities to each other. It is preferable that a voltage having an opposite polarity to the polarity of the unfixed toner carried on the recording medium be applied to the electrode 7. It is because the electrode 7 and the unfixed toner which only electrostatically attach to the recording medium 3 attract each other by a coulomb force. Accordingly, it becomes less likely that the toner image is moved or scattered by an external force and the like. Further, it becomes possible to carry the recording medium 3 by electrostatically attracting the recording medium 3 on the carrier belt 4. As a result, a jam of the recording medium 3 becomes less likely to occur in the fixing apparatus 2.

Description is made of the case where the electrode 7 and the droplets 10*a* of the fixing solution have the same polarity. In this case, the guiding roller 6 is required to have the same polarity as the electrode 7 and the droplets 10*a* of the fixing solution. If the guiding roller 6 has an opposite polarity to the polarity of the electrode 7 and the droplets 10*a* of the fixing solution, the droplets 10*a* of the fixing solution are subjected to an electric field that causes the droplets 10*a* to be moved to the guiding roller 6 between the electrode 7 and the guiding roller 6. Therefore, when the electrode 7 and the droplets 10*a* of the fixing solution have a positive polarity, it is required to apply a positive voltage from the DC power source to the guiding roller 6 as well. When the electrode 7 and the droplets 10*a* of the fixing solution have a negative polarity, it is required to apply a negative voltage from the DC power source to the guiding roller 6 as well.

However, even when the guiding roller 6, the electrode 7, and the droplets 10*a* of the fixing solution have the same polarity, the droplets 10*a* of the fixing solution may be moved to the guiding roller 6 by being subjected to a force of an electric field generated between the electrode 7 and the guiding roller 6, depending on a direction of the generated electric field. Therefore, to move the droplets 10*a* of the fixing solution to the electrode 7 by setting the guiding roller 6, the electrode 7, and the droplets 10*a* of the fixing solution to have the same polarity, voltages applied to the guiding roller 6 and the electrode 7 are required to be controlled. In specific, when the electrode 7 and the droplets 10*a* of the fixing solution have the positive polarity, a positive voltage is required to be applied from the DC power source to the guiding roller 6 so that the guiding roller 6 has a higher potential than the potential of the electrode 7. When the electrode 7 and the droplets 10*a* of the fixing solution have the negative polarity, a negative voltage is required to be applied from the DC power source to the guiding roller 6 so that the guiding roller 6 has a lower potential than the potential of the electrode 7.

Next, a description is made of the case where the electrode 7 is grounded. When the electrode 7 is grounded, a voltage is required to be applied from the DC power source to the guiding roller 6 so that the guiding roller 6 and the droplets 10*a* of the fixing solution have the same polarity. When the guiding roller 6 and the droplets 10*a* of the fixing solution have opposite polarities to each other, the droplets 10*a* of the fixing solution are subjected to a force from the electric field generated between the electrode 7 and the guiding roller 6 to move to the guiding roller 6. Therefore, a voltage is required to be applied from the DC power source to the guiding roller 6 so that the guiding roller 6 and the droplets 10*a* of the fixing solution have the same polarity when the electrode 7 is grounded.

Next, a description is made of a relationship between the polarities of the guiding roller 6 and the droplets 10*a* of the fixing solution. In this embodiment, the guiding roller 6 is grounded (earth) and the ionizer 12 is used as the fixing solution charging unit to negatively charge the droplets 10*a* of the fixing solution. That is, there is a potential difference between the guiding roller 6 and the charged droplets 10*a* of the fixing solution; however, no coulomb force is generated between them. This state prevents the droplets 10*a* of the fixing solution from attaching to the surface of the guiding roller 6. Once the droplets 10*a* of the fixing solution attach to the surface of the guiding roller 6, the droplets 10*a* can be reliably guided to the space between the guiding roller 6 and the electrode 7 by the rotation of the guiding roller 6. However, an attachment force between the guiding roller 6 and the droplets 10*a* of the fixing solution is sometimes larger than the force applied to the droplets 10*a* of the fixing solution by the electric field generated between the electrode 7 and the guiding roller 6. In such a case, the droplets 10*a* of the fixing solution attached to the guiding roller 6 do not attach to the toner carried on the recording medium 3, but remains attached to the guiding roller 6. Therefore, it is not preferable to generate an attracting coulomb force (attraction force) between the guiding roller 6 and the droplets 10*a* of the fixing solution. When the attracting coulomb force is generated between the guiding roller 6 and the droplets 10*a* of the fixing solution, it is necessary that the droplets 10*a* of the fixing solution are subjected to a larger force by the electric field generated between the guiding roller 6 and the electrode 7 than the attraction force with the guiding roller 6.

On the other hand, when the droplets 10*a* of the fixing solution and the guiding roller 6 have the same polarity, a repulsive coulomb force (repulsive force) is generated between them. Therefore, there is no possibility that the droplets 10*a* of the fixing solution attach to the guiding roller 6 in the spray box 28. Therefore, the droplets 10*a* of the fixing solution and the guiding roller 6 may have the same polarity. However, since the droplets 10*a* of the fixing solution cannot sometimes approach the surface of the guiding roller 6 due to the repulsive coulomb force, the repulsive coulomb force is preferably as small as possible. That is, it is most preferable that the guiding roller 6 be grounded as in the configuration of this embodiment.

As described above, it is important to apply a voltage to at least one of the guiding roller 6 and the electrode 7 from the DC power source so that the droplets 10*a* of the fixing solution move to the electrode 7 side by being subjected to force of the electric field generated between the guiding roller 6 and the electrode 7. In this case, it is most preferable to set a relationship of the polarities of the guiding roller 6, the electrode 7, and the droplets 10*a* of the fixing solution such that a coulomb force is not generated between the guiding roller 6 and the droplets 10*a* of the fixing solution. Further, it is preferable that the electrode and the unfixed toner carried on the recording medium 3 have opposite polarities to each other. That is, by considering that toner having a negative polarity is predominantly used, the combination of polarities described in this embodiment is optimal, where the guiding roller 6 is grounded, the electrode 7 has a positive polarity, and the droplets 10*a* of the fixing solution are negatively charged.

Table 1 shows specific combinations of the polarities of the electrode 7, the guiding roller 6, and the droplets 10*a* of the fixing solution.

TABLE 1

| | Electrode 7 | Guiding roller 6 | Droplets 10a of fixing solution |
|---|---|---|---|
| (1) | + | 0 (earth) | − |
| (2) | + | − | − |
| (3) | + | + | + |
| (4) | + | + | − |
| (5) | + | 0 (earth) | + |
| (6) | + | − | + |
| (7) | − | 0 (earth) | + |
| (8) | − | + | + |
| (9) | − | − | − |
| (10) | − | − | + |
| (11) | − | 0 (earth) | − |
| (12) | − | + | − |
| (13) | 0 (earth) | + | + |
| (14) | 0 (earth) | − | − |
| (15) | 0 (earth) | + | − |
| (16) | 0 (earth) | − | + |
| (17) | 0 (earth) | 0 (earth) | − |
| (18) | 0 (earth) | 0 (earth) | + |

As shown in Table 1, there are various combinations of the polarities. Each combination is described below. First, a combination of the polarities which are opposite to those of this embodiment ((1) in Table 1) is described. In specific, a negative voltage is applied to the electrode 7 and the droplets 10*a* of the fixing solution are charged to have a positive polarity ((7) in Table 1). With this configuration, a coulomb force (attracting or repulsive force) is not generated between the guiding roller 6 and the droplets 10*a* of the fixing solution which are positively charged. Moreover, the droplets 10*a* of the fixing solution move to the electrode 7 by being subjected to a force of an electric field generated between the guiding roller 6 and the electrode 7. Therefore, this combination can be employed in a similar manner to the combination (1) in Table 1. However, since toner having a negative polarity is predominantly used as described above, it is preferable to apply a positive voltage to the electrode 7 as in this embodiment. Accordingly, the unfixed toner having a negative polarity, which is carried on the recording medium 3, is attracted to the electrode 7 having a positive polarity, which is provided on the opposite side of the recording medium to the unfixed toner. As a result, the probability that the unfixed toner is scattered by, for example, various external shocks (external forces) can be reduced.

Next, a different combination of polarities from that of this embodiment is described below. As described above, with the polarities of the electrode 7 and the droplets 10*a* exchanged (for example, (1) and (7) in Table 1), the same effect can be obtained when the polarity of the unfixed toner is not taken into consideration. Therefore, the case where a positive voltage is applied to the electrode 7 ((1) through (6) in Table 1) and the case where the electrode 7 is grounded ((13) through (18) in Table 1) are described here, while description of the case where a negative voltage is applied to the electrode 7 ((7) through (12) in Table 1) is omitted.

A combination (2) of the polarities shown in Table 1 corresponds to the case where the electrode 7 has a positive polarity while the guiding roller 6 and the droplets 10*a* of the fixing solution have a negative polarity. In the case of this combination, an attracting coulomb force (attraction force) is not generated between the negatively charged droplets 10*a* and the guiding roller 6 to which the negative voltage is applied. The droplets 10*a* of the fixing solution are moved to the electrode 7 side by being subjected to a force from an electric field generated between the electrode 7 and the guiding roller 6. Therefore, this combination of the polarities can be employed. The combinations (13) and (14) shown in Table 1 are not described here since the same effect as the combination (2) can be obtained by them.

Next, the combination (3) of the polarities shown in Table 1 corresponds to the case where the electrode 7, the guiding roller 6, and the droplets 10*a* of the fixing solution have positive polarities. In the case of this combination, it is important to control the relationship between the potentials of the electrode 7 and the guiding roller 6. It is because there may be a case where the droplets 10*a* of the fixing solution are moved to the guiding roller 6 side by being subjected to a force of an electric field generated between the guiding roller 6 and the electrode 7, instead of being moved to the electrode 7. Therefore, when the electrode 7, the guiding roller 6, and the droplets 10*a* of the fixing solution have the positive polarities, it is necessary to set the potential of the guiding roller 6 to be higher than that of the electrode 7. In the case of this combination, it is required to apply a voltage from the DC power source to the electrode 7 and the guiding roller 6 to set the potentials of them such that the droplets 10*a* of the fixing solution move to the electrode 7 by being subjected to a force of the electric field generated between the electrode 7 and the guiding roller 6.

A combination (4) of the polarities shown in Table 1 corresponds to the case where the electrode 7 and the guiding roller 6 have positive polarities while the droplets 10*a* of the fixing solution have a negative polarity. In the case of this combination, a potential of the guiding roller 6 is required to be set higher than that of the electrode 7. If the electrode 7 has a higher potential than the guiding roller 6, the negatively charged droplets 10*a* of the fixing solution move to the guiding roller 6 by being subjected to a force of the electric field. Therefore, a voltage is required to be applied to the electrode 7 and the guiding roller 6 such that the droplets 10*a* of the fixing solution move to the electrode 7 by being subjected to a force of an electric field generated between the electrode 7 and the guiding roller 6. That is, this combination of the polarities can be employed depending on the relationship of the potentials between the electrode 7 and the guiding roller 6.

On the other hand, a combination (5) of the polarities shown in Table 1 corresponds to the case where the electrode 7 and droplets 10*a* of the fixings solution have positive polarities while the guiding roller 6 is grounded. In the case of this combination, the droplets 10*a* of the fixing solution are subjected to a force of an electric field toward the guiding roller 6 between the electrode 7 and the guiding roller 6. Since the droplets 10*a* of the fixing solution do not attach to the unfixed toner carried on the recording medium, this combination of the polarities cannot be employed. For the same reason as this combination (5), combinations (6), (15), and (16) shown in Table 1 cannot be employed either.

Combinations (17) and (18) of the polarities shown in Table 1 correspond to the case where the electrode 7 and the guiding roller 6 are both grounded. Since there is no potential difference between the electrode 7 and the guiding roller 6, generating no electric field between them, the droplets 10*a* of the fixing solution do not move to the electrode 7 by a force of an electric field. Therefore, these combinations cannot be employed either.

Next, a relationship between the recording medium 3 and the electrode 7 is described. It is preferable that the recording medium 3 be electrostatically attached onto the carrier belt 4. By carrying the recording medium 3 electrostatically attached onto the carrier belt 4 between the guiding roller 6 and the electrode 7, wrinkles or curls of the recording medium 3 can be suppressed. Consequently, a jam of the recording medium 3 in the fixing part, and a defect of a formed image can be prevented. When a voltage is applied to the electrode 7, the same member may serve as the carrier belt 4 and the electrode 7. For example, a voltage may be applied to a single member such as a carrier roller. With this configuration, the configuration of the components can be simplified compared to the case of using both the electrode 7 and the carrier belt 4.

It is preferable that the guiding roller 6 be rotated only in a direction α, which is the direction the recording medium 3 is carried. As a result, rotation directions of the carrier belt 4 and the guiding roller 6 become the same between the guiding roller 6 and the electrode 7. When the carrier belt 4 and the guiding roller 6 rotate in the same direction, an air flow to guide the droplets 10*a* of the fixing solution into the space between the guiding roller 6 and the electrode 7 can be enhanced. Therefore, guiding efficiency of the droplets 10*a* of the fixing solution can be improved.

In this embodiment, the guiding roller 6 is rotated at a speed of 200 mm/sec, which is equal to a speed at which the recording medium 3 is carried; however, the speed of the guiding roller 6 is not limited to this. Since the guiding roller 6 is rotated in order to generate an air flow over a surface layer of the guiding roller 6, the speed of the rotation is not limited. That is, it is preferable that the guiding roller 6 be rotated at such a speed that an air flow flowing in a direction of the rotation of the guiding roller 6 is generated over the surface layer of the guiding roller 6.

Embodiment 2

Figure 4:
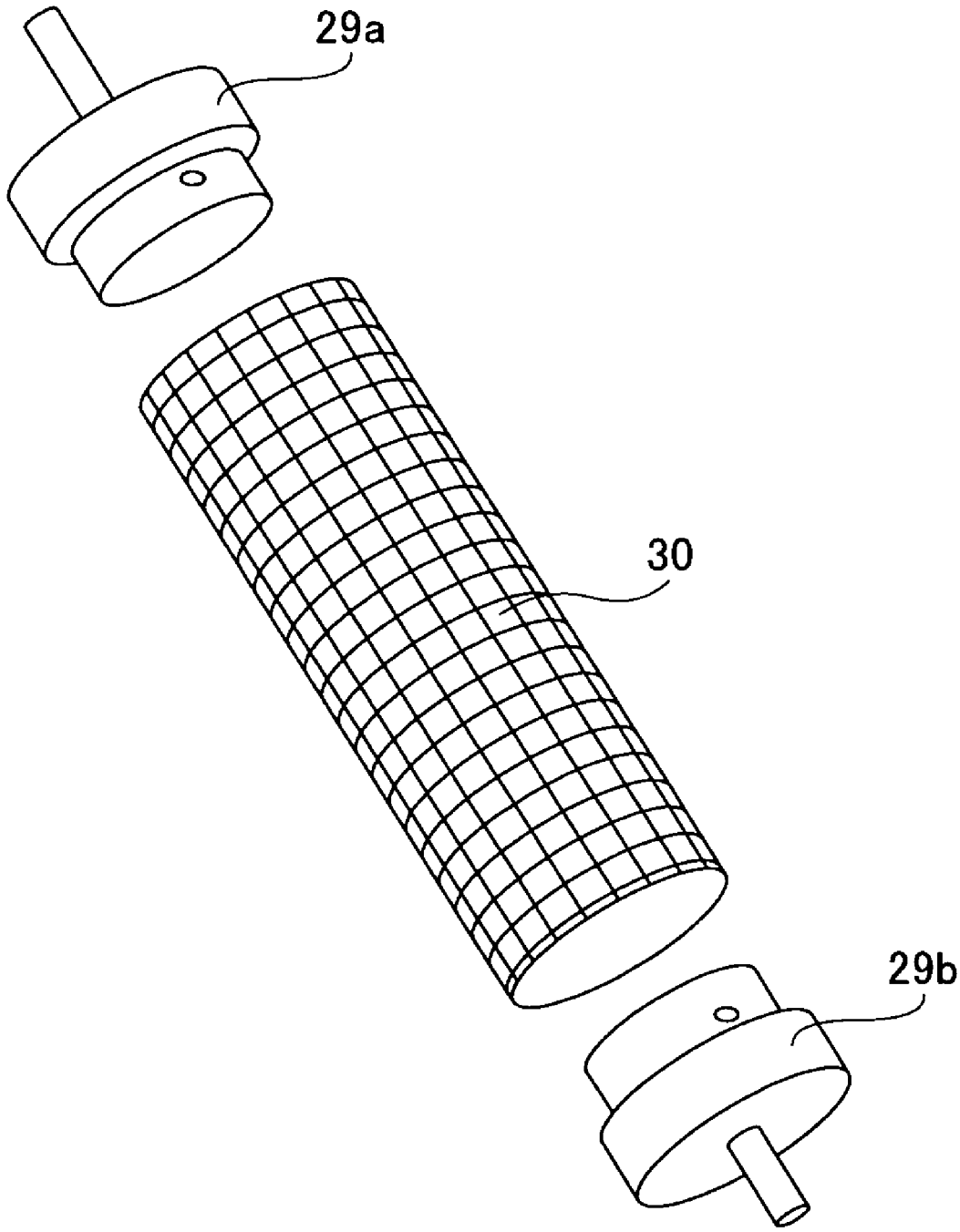
FIG. 4 is a perspective view of a guiding roller formed of a reticulated member having a hollow center according to the present invention.
Figure 5:
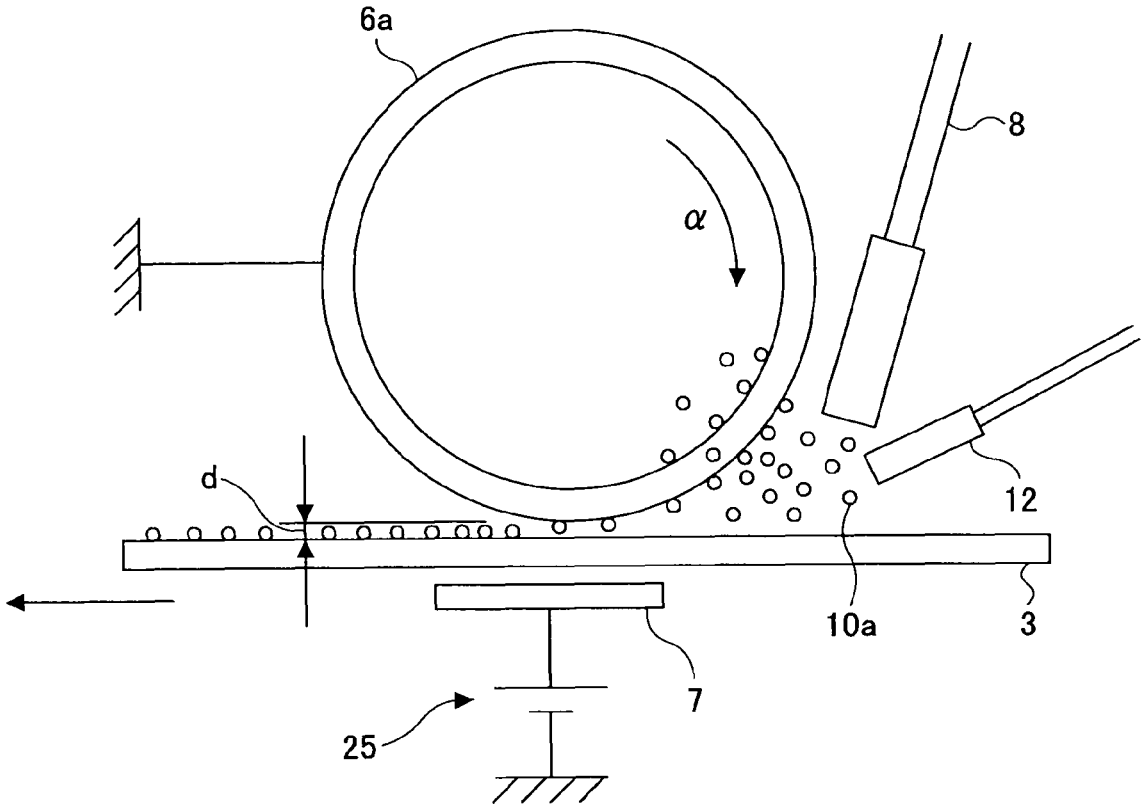
FIG. 5 is a detailed drawing of a fixing apparatus according to embodiment 2 of the present invention.

Next, an embodiment 2 of the present invention is described. Embodiment 2 is different from embodiment 1 in that a guiding roller 6*a* formed of a reticulated member having a hollow center is used instead of the guiding roller 6. FIG. 4 is a diagram showing details of the guiding roller 6*a*. FIG. 5 is a perspective view of a fixing apparatus 2*a* including the guiding roller 6*a*. The same components as those in embodiment 1 are denoted by the same reference numerals and description of them is not repeated.

When a distance between electrodes is shorter, a strength of an electric field generated between the electrodes is stronger. In embodiment 1; however, when a distance between the electrode 7 and the guiding roller 6 serving as the electrode is shorter, fluid resistance between the electrodes becomes larger. Thus, an air flow does not easily flow into a space between the electrodes. Therefore, when a shortest distance d between the electrodes of the electrodes 7 and the guiding roller 6 in embodiment 1 is shorter, the droplets 10*a* of the fixing solution, which float in the spray box 28, are not efficiently guided into the space between the electrodes. Thus, a fixation defect may occur. On the other hand, when the shortest distance d between the electrodes is longer, an electric field generated between the electrodes is weakened and the fluid resistance between the electrodes becomes lower. As a result, the droplets 10*a* of the fixing solution are subjected to a larger force by an air flow flowing into the space between the electrodes, than a force of an electric field generated between the electrodes. Consequently, attachment efficiency between the droplets 10*a* of the fixing solution and the unfixed toner carried on the recording medium 3 is reduced. In embodiment 2, on the other hand, the guiding roller 6*a* which is formed of a reticulated member having a hollow center is used as the electrode provided on a side of the surface carrying the unfixed toner of the recording medium 3. Accordingly, the droplets 10*a* of the fixing solution can be efficiently guided into the space between the electrodes, with the distance d between the electrodes set equal to or shorter than that of embodiment 1.

As shown in FIG. 4, a central part of the guiding roller 6*a* in a roller axle direction is formed of a reticulated member 30 which is a hollow cylindrical member, while opposing ends of the guiding roller 6*a* in the roller axle direction are fixed by flanges 29*a* and 29*b*. In this embodiment, the guiding roller 6*a* is formed of the reticulated member 30 except for the flanges at the opposing ends; however, the reticulated member 30 is not limited to this configuration as long as a reticulated part is at least as long as a width of a recording member. The reticulated member 30 may be formed of a material having superior conductivity such as a metal, which may be appropriately determined depending on the kind or characteristics of the fixing solution to be used. In this embodiment, a reticulated member formed by weaving wires 24 like a cage is used.

A fixing operation by using the guiding roller 6*a* formed of a reticulated member having a hollow center is described below. When the guiding roller 6*a* shown in FIG. 5 is rotated, an air flow is generated over a surface of the guiding roller 6*a* in a similar manner to embodiment 1. Accordingly, the droplets 10*a* of the fixing solution which are negatively charged by the ionizer 12 and floating in the spray box 28, are guided into the space between the electrode 7 receiving a positive voltage and the guiding roller 6*a* receiving a negative voltage. The droplets 10*a* are then subjected to a force of an electric field generated between the electrode 7 and the guiding roller 6*a* and move to the electrode 7. Then, the droplets 10*a* attach to the unfixed toner carried on the recording medium 3, which passes between the electrode 7 and the guiding roller 6*a*. This method of fixation is similar to embodiment 1.

Here, a difference between embodiments 1 and 2 is described. In the case where the guiding roller 6 which is not reticulated is used, and the shortest distance d between the electrodes is about 1 mm, fluid resistance between the electrodes is increased. Thus, an air flow generated by the rotation of the guiding roller 6 does not pass through the space between the electrodes and causes the droplets 10*a* of the fixing solution to deviate to the periphery where fluid resistance is lower than the space between the electrodes. However, in embodiment 2, when using the guiding roller 6*a* including the reticulated member 30 having a hollow center, the fluid resistance between the electrodes can be further suppressed by an effect of the hollow part of the reticulated member 30, even when the shortest distance d between the electrodes is short. Therefore, the droplets 10*a* of the fixing solution can be guided into the space between the electrodes.

Further, as shown in FIG. 5, the droplets 10*a* of the fixing solution which were not guided into the space between the electrodes can slip into the hollow part of the guiding roller 6*a* through holes (parts with no wire of the reticulated member 30) of the reticulated member 30 to float at a position close to the positively charged electrode 7. Therefore, the droplets 10*a* of the fixing solution which are negatively charged are attracted to the electrode 7 by a coulomb force generated with the electrode 7. By this effect, the droplets 10*a* of the fixing solution pass through the holes of the guiding roller 6*a* again and guided into the space between the electrode 7 and the guiding roller 6*a*. A relationship among polarities of the electrode 7, the guiding roller 6*a*, and the droplets 10*a* may be set such that the droplets 10*a* move to the electrode 7 by being subjected to a force of an electric field generated between the guiding roller 6*a* and the electrode 7. Specific combinations of the polarities are the same as those described in embodiment 1; therefore, they are not described here. It is most preferable to set the polarities such that no coulomb force is generated between the guiding roller 6*a* and the droplets 10*a* of the fixing solution, for the same reason as embodiment 1. That is, it is most preferable to ground (earth) the guiding roller 6*a* which includes the reticulated member having a hollow center.

Figure 6:
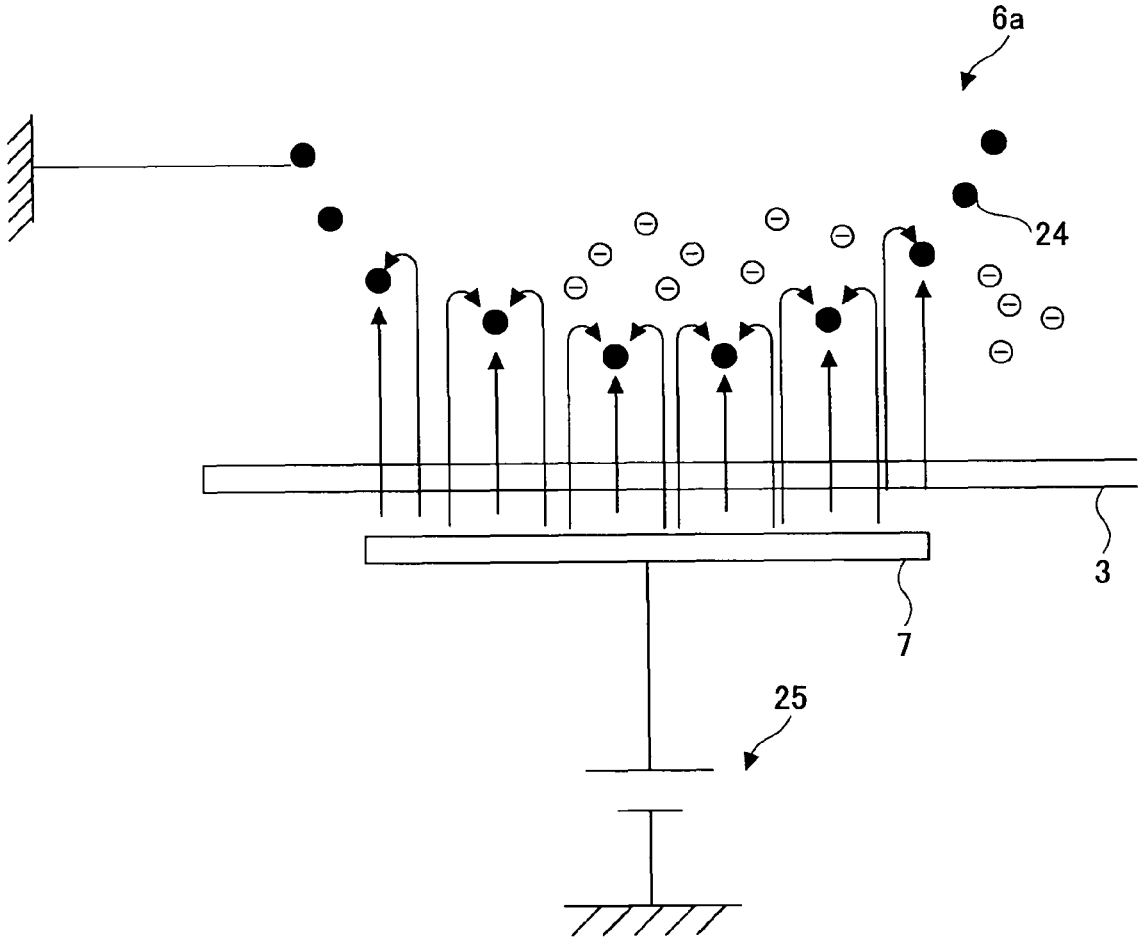
FIG. 6 is a detailed drawing showing droplets of a fixing solution subjected to forces, according to embodiment 2 of the present invention.

FIG. 6 is a diagram showing a principle that the droplets 10*a* present in the hollow part of the guiding roller 6*a* attach to the unfixed toner carried on the recording medium 3. Between the electrode 7 and the wires 24 serving as components of the reticulated member 30, electric fields are generated in such a manner that the electric fields surround the wires 24. That is, the droplets 10*a* of the fixing solution which come out of the reticulated member 30 through the holes into the space between the electrodes are subjected to a force of the generated electric fields. Thus, the droplets 10*a* are accelerated by the force of the electric fields to attach to the unfixed toner carried on the recording medium 3. By this effect, the attachment efficiency can be improved between the droplets 10*a* of the fixing solution which come out of the hollow part of the reticulated member 30 into the space between the electrodes, and the unfixed toner carried on the recording medium 3. That is, by using the guiding roller 6*a* that includes the reticulated member 30 having a hollow center, air resistance can be lessened and a larger amount of the droplets 10*a* of the fixing solution can be guided into the space between the electrodes by the air flow generated by the rotation of the guiding roller 6*a*. At the same time, the droplets 10*a* of the fixing solution which have entered the hollow part of the reticulated member 30 come out of the hollow part into the space between the electrodes by the coulomb force between the droplets 10*a* and the electrode 7. Therefore, guidance efficiency of the droplets 10*a* into the space between the electrodes can be improved compared to embodiment 1. By the effects as described above, the attachment efficiency can be further improved between the unfixed toner carried on the recording medium 3 and the droplets 10*a* of the fixing solution while maintaining the distance d between the electrodes to be equal to or less than that of embodiment 1.

The distance d between the electrodes can be appropriately set depending on the thickness, type, and the like of paper that passes between the electrodes. It is preferable that an appropriate gap width be set as the distance d such that the guiding roller 6*a* does not contact the unfixed toner on the recording medium and the recording medium is not wrinkled or curled. In this embodiment, a gap width of 1 mm is set as the shortest distance d between the electrode 7 in the plate shape and the guiding roller 6*a* formed of the reticulated member having a hollow center; however, the distance d is not limited to this.

Embodiment 3

Figure 7:
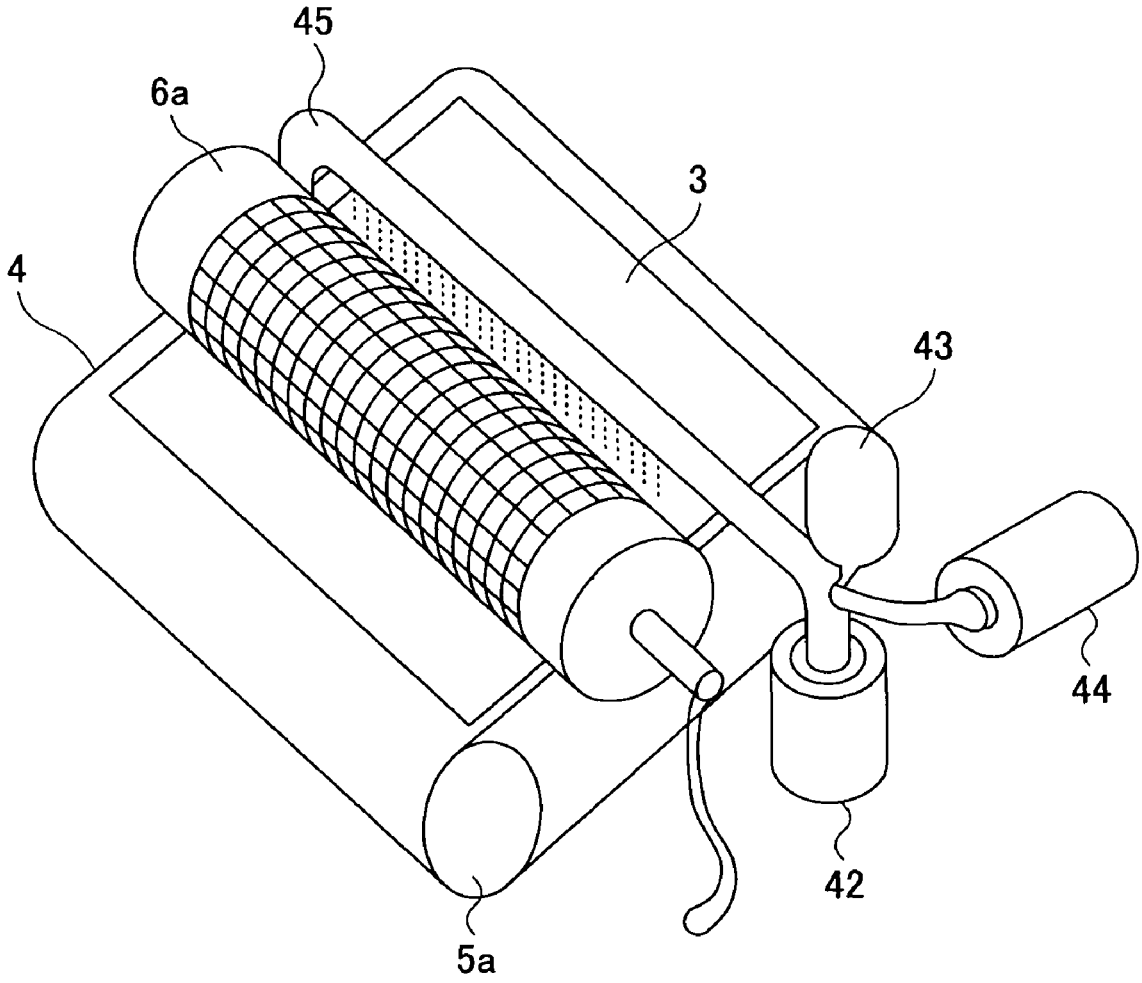
FIG. 7 is a diagram showing a fixing apparatus according to embodiment 3 of the present invention.

In embodiment 3, the sprayer 8 and the ionizer 12 described in embodiments 1 and 2 are integrated so that the fixing solution 10 is charged by a charging unit such as the ionizer before being sprayed from the sprayer 8. FIG. 7 is a diagram showing one configuration of this embodiment. The same components as those in embodiments 1 and 2 are denoted by the same reference numerals.

In FIG. 7, the sprayer 8 and the ionizer 12 are integrated. A fixing solution holding member 42 incorporates the fixing solution 10 and the oscillator 9. In a similar manner to embodiment 1, an alternating current with a high frequency is applied to the oscillator 9 so that the micro droplets 10*a* of the fixing solution 10 (hereinafter simply referred to as the droplets 10*a* of the fixing solution) are generated on the surface of the fixing solution 10. The droplets 10*a* of the fixing solution have a diameter of 16 μm or less, which are formed by a method similar to that described in embodiment 1.

The droplets 10*a* of the fixing solution which are generated on the surface of the fixing solution are sent to a carry path 45 by an air flow generated by a pump 43. In this embodiment, the droplets 10*a* of the fixing solution are negatively charged by an effect of an ionizer 44 while being carried. That is, the carry path 45, which is provided in a width direction of the recording medium 3 carried into the fixing apparatus 2, incorporates the charged droplets 10*a* of the fixing solution. The droplets 10*a* which are charged by the ionizer 44 are sprayed into the spray box 28 through slits provided on a bottom surface of the carry path 45. With this configuration, the droplets 10*a* of the fixing solution can be more reliably charged and sprayed into the spray box 28, compared to embodiments 1 and 2. Therefore, the amount of the droplets 10*a* of the fixing solution, which are not subjected to any force by an electric field and do not attach to the unfixed toner carried on the recording medium 3, can be reduced.

Figure 8:
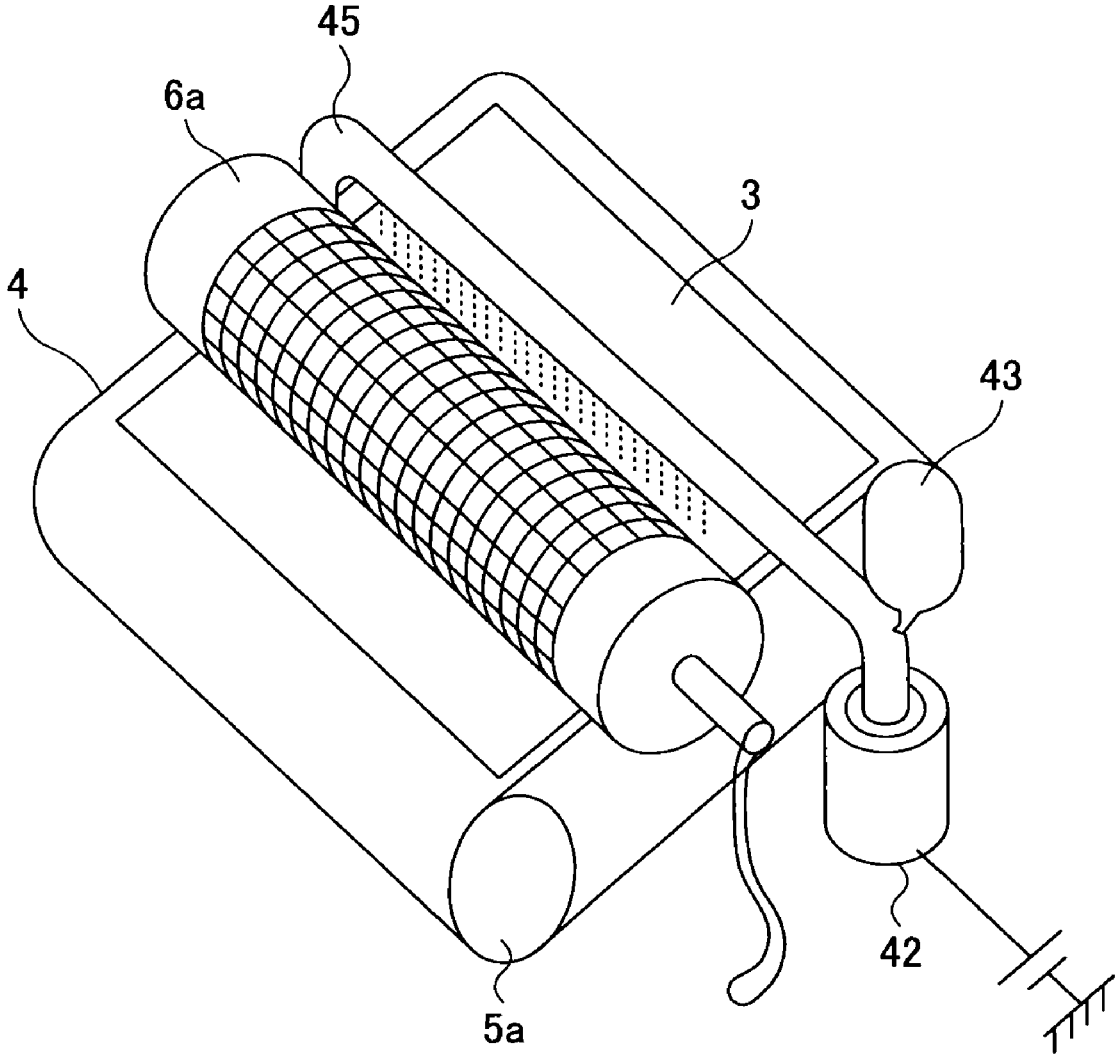
FIG. 8 is a diagram showing a fixing apparatus according to embodiment 4 of the present invention.

In FIG. 8, the fixing solution holding member 42 is formed of a conductive member. By applying a high voltage to the fixing solution holding member 42, the fixing solution 10 incorporated in the fixing solution holding member 42 is charged to be the same potential as the fixing solution holding member 42. Since the ionizer is not required by this method, the fixing apparatus can have a simpler configuration.

In this manner, the droplets 10*a* of the fixing solution to be sprayed may be charged before or after the droplets 10*a* are generated.

In FIGS. 7 and 8, the guiding roller 6*a* formed of the reticulated member having a hollow center described in embodiment 2 is used; however, a guiding roller is not limited to this. The guiding roller 6 described in embodiment 1, a belt, a rotatable electrode, and the like may be used as well.

Embodiment 4

Figure 9:
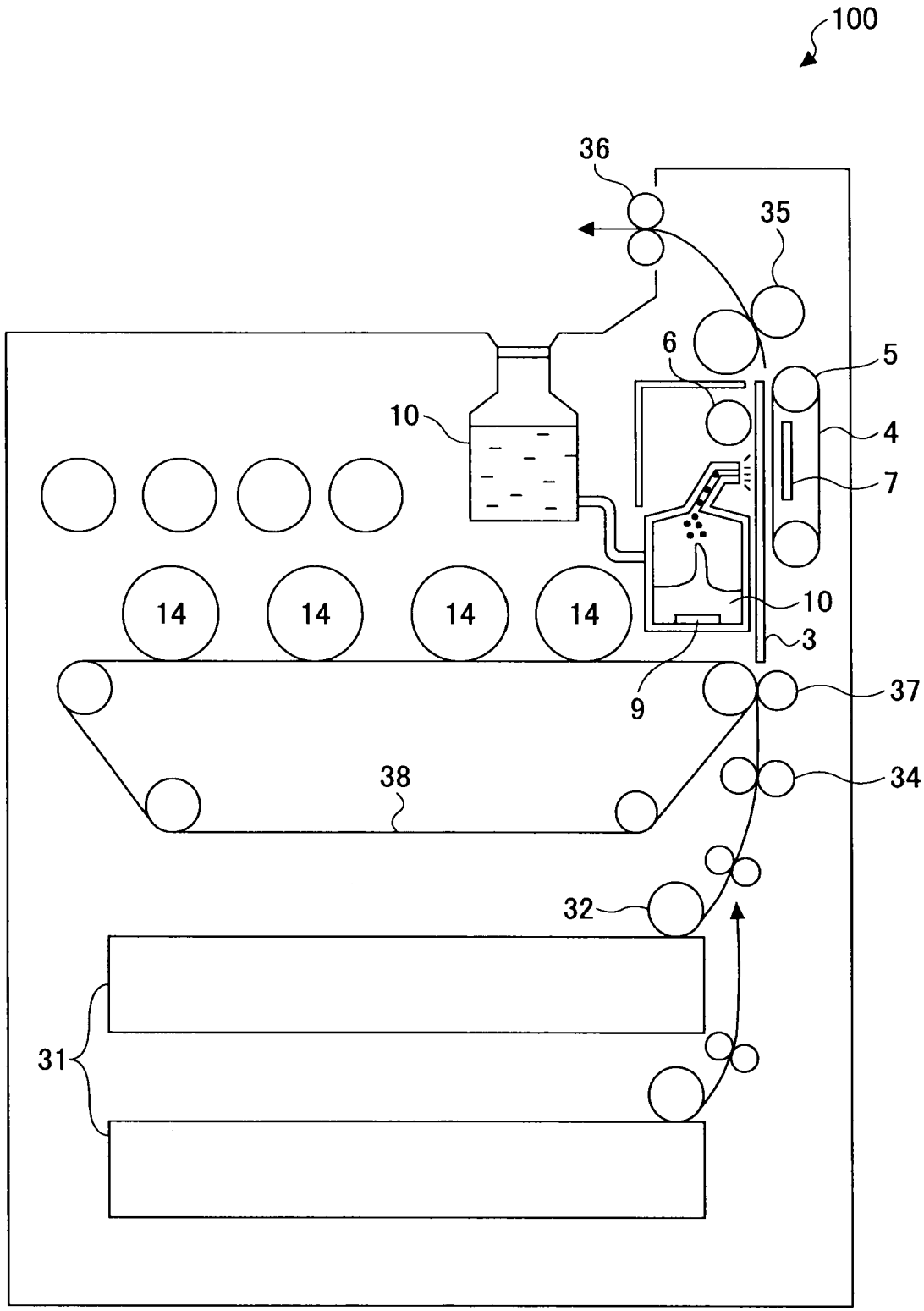
FIG. 9 is an overall configuration diagram of an image forming apparatus employing the vertical carrying method, to which a fixing apparatus of the present invention is applied.

In embodiment 4, the fixing apparatus of the present invention is used in a fixing part of an image forming apparatus that employs a vertical carrying method. FIG. 9 is a diagram showing an overall configuration of an image forming apparatus 100 employing the vertical carrying method. Components of an image forming part of this image forming apparatus are denoted by the same reference numerals as embodiments 1, 2, and 3 and are not described here since its configuration is similar to those in embodiments 1, 2, and 3.

The recording medium 3 in a paper feed cassette 31 is picked up as one sheet by a pick up roller 32 and temporarily stops at a resist roller 34. Here, the recording medium 3 is corrected in skew and carried to a transfer roller 37 at an appropriate timing. Since an intermediate transfer belt 38 is used in this embodiment, toner images of the photosensitive bodies 14 are primarily transferred onto the intermediate transfer belt 38, and the unfixed toner image on the intermediate transfer belt 38 is secondarily transferred onto the recording medium 3 by the transfer roller 37. Then, the recording medium 3 is carried into the fixing apparatus 2.

In embodiment 4, the droplets 10*a* of the fixing solution are attached onto the unfixed toner carried on the recording medium 3 by the force of an electric field generated by a commercial power source and the like between the guiding roller 6 and the electrode 7, in a similar manner to embodiment 1. Therefore, the recording medium 3 carried into the fixing apparatus 2 is attracted to the electrode 7 provided on the opposite side of the recording medium 3 to the surface carrying the unfixed toner so as to be carried being electrostatically attached on the carrier belt 4. Thus, the recording medium 3 can be reliably carried out of the fixing apparatus 2 even by the vertical carrying method. Moreover, wrinkles and curls of the recording medium 3 can be reduced by the electrostatic attachment. The droplets 10*a* of the fixing solution generated and sprayed by the sprayer 8 have a diameter of 16 μm or less. Therefore, even when the image forming apparatus 100 employs the vertical carrying method, the droplets 10*a* can be floated and impregnated in the spray box 28 without leaking in the image forming apparatus 100 from a bottom part of the fixing apparatus 2. By using the fixing apparatus 2 of the present invention, the recording medium can be attached onto the carrier belt 4 when carried, and the micro droplets 10*a* of the fixing solution can be formed. Therefore, the fixing apparatus 2 of the present invention can be easily applied to the image forming apparatus 100 employing the vertical carrying method as well as the image forming apparatus employing the horizontal carrying method.

In FIG. 9, a pressure roller 35 is provided on a downstream side of the fixing apparatus 2 in a carrying direction of the recording medium 3. The pressure roller 35 is used to press toner softened by the fixing solution. A surface of the pressure roller 35, which contacts the recording medium 3, is formed of a fluorine resin having a superior release property. The softened toner is uniformly pressed by the pressure roller 35 to be fused (anchored) in the recording medium 3. In this manner, a fixing property and glossiness of the toner can be improved by this fusing (anchoring) effect. The pressure roller 35 may be omitted if unnecessary.

According to at least one embodiment of the present invention, by rotating a first electrode positioned on a side of a surface carrying unfixed toner of a recording medium, an air flow is generated in a rotation direction of the first electrode. By the air flow, the droplets of the fixing solution can be efficiently guided into the space between the first electrode and a second electrode which is positioned on the opposite side of the recording medium to the surface carrying the unfixed toner. Moreover, by the force of an electric field generated between the first electrode and the second electrode, the guided droplets of the fixing solution move to the second electrode. Thus, the attachment efficiency between the unfixed toner carried on the recording medium and the droplets can be improved, and a probability that images are formed with a defect can be reduced.

According to at least one embodiment of the present invention, the first electrode is formed of a reticulated member having a hollow center. Thus, air resistance can be further reduced between the first and second electrodes compared to the above aspects. Therefore, the droplets of the fixing solution can enter the hollow part of the first electrode to be positioned close to the second electrode. Thus, as compared to claims 1 through 8, the attachment efficiency can be further improved between the droplets of the fixing solution and the unfixed toner carried on the recording medium. At the same time, a probability that images are formed with a defect can be reduced.

According to at least one embodiment of the present invention, by charging the fixing solution prior to spraying the fixing solution, the configuration of the fixing apparatus can be simplified and the droplets can be reliably charged.

According to at least one embodiment of the present invention, the first electrode also functions as a guiding member to carry the recording medium out of the fixing apparatus. Thus, a probability that a jam of the recording medium occurs in the fixing part can be reduced.

According to at least one embodiment of the present invention, power consumption can be considerably reduced since no heat is used. Moreover, an image forming apparatus that prevents a defect of a formed image can be provided.

This patent application is based on Japanese Priority Patent Application No. 2008-171497 filed on Jun. 30, 2008, the entire contents of which are hereby incorporated herein by reference.

What is claimed is:

1. A fixing apparatus to fix unfixed toner carried on a surface of a recording medium by attaching a fixing solution capable of softening toner onto the unfixed toner, comprising:

a sprayer configured to spray the fixing solution;

a fixing solution charging part configured to charge the fixing solution;

a first electrode configured to rotate and provided on a same side of the recording medium as the surface carrying the unfixed toner;

a second electrode provided on an opposite side of the recording medium to the surface carrying the unfixed toner; and a voltage applying part configured to generate an electric field between the first electrode and the second electrode so that the fixing solution sprayed by the sprayer and charged by the fixing solution charging part moves toward the second electrode.

2. The fixing apparatus as claimed in claim 1, wherein the voltage applying part applies a voltage to the second electrode so that the second electrode has an opposite polarity to a polarity of the fixing solution that is charged by the fixing solution charging part.

3. The fixing apparatus as claimed in claim 2, wherein the first electrode is grounded.

4. The fixing apparatus as claimed in claim 1, wherein the voltage applying part applies a voltage to the first electrode and the second electrode so that the first electrode and the second electrode have opposite polarities to each other.

5. The fixing apparatus as claimed in claim 1, wherein the voltage applying part applies a voltage to the second electrode so that the second electrode has the same polarity as a polarity of the fixing solution that is charged by the fixing solution charging part.

6. The fixing apparatus as claimed in claim 5, wherein when the same polarity is a positive polarity, the voltage applying part applies a voltage to the first electrode so that the first electrode has a higher potential than a potential of the second electrode.

7. The fixing apparatus as claimed in claim 5, wherein when the same polarity is a negative polarity, the voltage applying part applies a voltage to the first electrode so that the first electrode has a lower potential than a potential of the second electrode.

8. The fixing apparatus as claimed in claim 1, wherein the voltage applying part applies a voltage to the first electrode so that the first electrode has the same polarity as a polarity of the fixing solution that is charged by the fixing solution charging part; and the second electrode is grounded.

9. The fixing apparatus as claimed in claim 1, further comprising a carrying member configured to carry the recording medium, wherein the recording medium passes between the first electrode and the second electrode, said recording medium being electrostatically attached to the carrying member.

10. The fixing apparatus as claimed in claim 9, wherein the carrying member serves as the second electrode.

11. The fixing apparatus as claimed in claim 1, wherein the first electrode includes a reticulated member having a hollow center.

12. The fixing apparatus as claimed in claim 1, wherein the fixing solution is charged by the fixing solution charging part before the fixing solution is sprayed by the sprayer.

13. The fixing apparatus as claimed in claim 1, wherein the first electrode rotates in a direction of carrying the recording medium out of the fixing apparatus.

14. An image forming apparatus having the fixing apparatus as claimed in claim 1.

* * * * *